US005298379A

United States Patent [19]

Adin et al.

[11] Patent Number: 5,298,379

[45] Date of Patent: Mar. 29, 1994

[54] RADIATION SENSITIVE ELEMENT WITH ABSORBER DYE TO ENHANCE SPECTRAL SENSITIVITY RANGE

[75] Inventors: Anthony Adin, Rochester; Richard L. Parton, Webster, both of N.Y.

[73] Assignee: Eastman Kodak Company, Rochester, N.Y.

[21] Appl. No.: 906,621

[22] Filed: Jun. 30, 1992

[51] Int. Cl.[5] ..... G03C 1/815

[52] U.S. Cl. ..... 430/510; 430/508; 430/517; 430/522; 430/519; 430/520; 430/521; 430/570; 430/572; 430/584; 430/944; 430/606

[58] Field of Search ..... 430/508, 510, 517, 522, 430/519, 520, 521, 570, 572, 584, 944, 606

[56] References Cited

U.S. PATENT DOCUMENTS

| | | | |
|---|---|---|---|
| 4,312,941 | 1/1982 | Scharf et al. | 430/510 |
| 4,469,785 | 9/1984 | Tanaka et al. | 430/570 |
| 4,536,473 | 8/1985 | Mihara | 430/575 |
| 4,618,570 | 10/1986 | Kadowaki et al. | 130/505 |
| 4,619,892 | 10/1986 | Simpson et al. | 430/505 |
| 4,711,838 | 12/1987 | Grzeskowiak et al. | 430/568 |
| 4,801,525 | 1/1989 | Mihara et al. | 430/517 |
| 4,839,265 | 6/1989 | Ohno et al. | 430/522 |
| 4,871,656 | 10/1989 | Parton et al. | 430/522 |
| 4,876,181 | 10/1989 | Proehi et al. | 430/522 |
| 4,882,265 | 11/1989 | Laganis et al. | 430/522 |
| 4,904,565 | 2/1990 | Schmidt et al. | 430/517 |
| 4,952,484 | 8/1990 | Katoh et al. | 430/517 |
| 5,013,642 | 5/1991 | Muenter et al. | 430/574 |

FOREIGN PATENT DOCUMENTS

| | | | |
|---|---|---|---|
| 0088595 | 9/1986 | European Pat. Off. . | |
| 0101646 | 2/1988 | European Pat. Off. . | |
| 0342939 | 11/1989 | European Pat. Off. . | |
| 3249141 | 10/1988 | Japan | 430/584 |
| 01013-5390A | 1/1989 | Japan . | |

OTHER PUBLICATIONS

Research Disclosure, vol. 308, Item 308 119, p. 1003, VIII. Absorbing and Scattering Materials, Dec. 1989, Kenneth Mason Publications, Ltd.

*Primary Examiner*—Charles L. Bowers, Jr.
*Assistant Examiner*—Thomas R. Neville
*Attorney, Agent, or Firm*—Gordon M. Stewart

[57] ABSTRACT

A radiation detecting element, particularly a photographic element having a radiation detecting composition, in particular a silver halide emulsion. The composition provides the element with a wavelength of peak sensitivity, λpeaksens, and a decreasing sensitivity around λpeaksens. An absorber dye of defined characteristics is chosen, which has the effect of decreasing the change in sensitivity which the element otherwise has without the absorber dye (that is, the absorber dye increases the wavelength range over which the sensitivity is relatively constant). The element is preferably sensitive to infra-red.

20 Claims, No Drawings

RADIATION SENSITIVE ELEMENT WITH ABSORBER DYE TO ENHANCE SPECTRAL SENSITIVITY RANGE

FIELD OF THE INVENTION

This invention relates to a radiation sensitive element, particularly a photographic element, which uses an absorber dye to attain a sensitivity of the element which is less sensitive to wavelength changes of incident radiation.

BACKGROUND OF THE INVENTION

A favoured technique for detecting radiation is through the use of a photographic element containing a silver halide emulsion. Such an element is usually exposed with light (which includes infra-red and ultraviolet as well as visible light) in order to form a latent image that is developed during photographic processing to form a visible image. Silver halide is intrinsically sensitive only to light in the blue region of the spectrum.

It is well known that to use sensitizing dyes to sensitize the silver halide to other than the blue region (for example, to other areas of the visible spectrum or to infrared light). Sensitizing dyes are chromophoric compounds (usually cyanine dye compounds). Their usual function is to adsorb to the silver halide and to absorb light (usually other than blue light) and transfer that energy via an electron to the silver halide grain thus, rendering the silver halide sensitive to radiation of a wavelength other than the blue intrinsic sensitivity. However, sensitizing dyes can also be used to augment the sensitivity of silver halide in the blue region of the spectrum. The resulting sensitized emulsion will generally have a sensitivity versus wavelength curve with a peak sensitivity the same as, or close to, the wavelength of peak absorption of the sensitizing dye used. The sensitivity curve will then fall off fairly rapidly on either side of the peak sensitivity wavelength.

One particular application of photographic elements in the form of paper or film, is for recording the output from devices such as laser printers which are designed to reproduce black and white or color digitized photographic images. Those printers operate by scanning a photographic element with a controlled laser beam modulated in accordance with the digital image. Following exposure, the photographic element is developed in the same manner as other photographic materials. Typically, the laser beam is in the infra-red region, for example 780nm, and is generated by laser diodes. Any color couplers incorporated in such a silver halide emulsion therefore produce a false-color image.

A difficulty with printers of the foregoing type is that the laser diodes vary in their output wavelength from diode to diode. For example, manufacturers may specify the wavelength of a monochrome printer being 780 nm±20 nm. Thus, there may be variation in wavelengths within a given printer using multiple diodes, as well as between printers. Since the sensitized emulsion has a wavelength dependent sensitivity curve as described above, the undesirable result is that the intensity of a given point to be recorded on the photographic element may vary from diode to diode and printer to printer. In view of this situation, IR sensitive films and papers used in such printers desirably have a constant photographic response over a range of wavelengths so as to provide invariable results in printers using an array of laser diodes, or from printer to printer.

One method for providing a broad sensitivity in the infrared region of the spectrum is described in U.S. Pat. No. 5,013,642 to Muenter et al. The Muenter et al. patent describes the use of a combination of sensitizing dyes with maximum sensitivities differing by between about 5 to 100 nm. It would be desirable though, to provide a radiation detecting element, particularly a silver halide photographic element useful in printers of the type described, which has a decreased change in sensitivity over a given wavelength range.

SUMMARY OF THE INVENTION

The present invention provides a radiation detecting element which has a decreased change in sensitivity over a given wavelength range as a result of using an absorber dye of the specified absorption characteristics. In particular, the invention provides a radiation detecting element which has a radiation detecting composition to detect incident radiation such that the element has a wavelength of peak sensitivity, λpeaksens, and decreasing sensitivity therearound. It will be noted that λpeaksens of the element is measured without the absorber dye, shortly described, being present. Also, the λpeakabs of the absorber dye will be a peak absorption of the dye in the same medium in which it will be present in the element. This may not necessarily be the same as a peak absorption of the dye in another medium (for example, the dye may have a peak absorption at a shorter wavelength when measured in alcohol than in a gelatin coating). Further, the element may have additional wavelengths of peak sensitivity (that is more than one peak sensitivity) as, for example, will be the case in an element designed to reproduce color.

The element is additionally provided with an absorber dye disposed in the detecting composition or alternatively, above the detecting composition (that is, disposed to be closer to a source of incident radiation to be detected). The absorber dye selected is one which has a wavelength of peak absorption, λpeakabs, within 10 nm (and preferably 5 nm) of λpeaksens (although the difference could be 2 nm or λpeakabs could equal λpeakabs), and a profile of decreasing absorption around λpeakabs. A dye with the foregoing parameters is chosen so as to decrease the change in sensitivity which the element would otherwise have in a region around λpeakabs if the absorber dye was not present (that is, to increase the wavelength range about λpeaksens over which sensitivity will remain relatively constant).

The radiation detecting element is preferably a photographic element which uses a silver halide emulsion sensitized with one or more, but preferably with only one, sensitizing dye.

DETAILED DESCRIPTION OF EMBODIMENTS OF THE INVENTION

A photographic element of the present invention comprises an emulsion sensitized with one or more absorber dyes as described. The absorber dye may be disposed in the emulsion itself, or above the emulsion (that is, positioned so that in normal use of the element, the absorber dye will be closer to the source of light to be detected). It will be understood, of course, that additional dyes such as an anti-halation dye, may be present on a back side of a base of the element, or on the same side of the base as the emulsion and beneath or above it. In addition, suitable filter dyes may also be used to prevent undesired radiation from reaching any emulsion in a photographic element of the present invention or to increase sharpness in the emulsion layer of the invention. Examples of anti-halation type dyes are described, for example, in U.S. Pat. No. 4,839,265. Examples of filter dyes include those described in U.S. Pat. No. 4,801,525. In any event though, the absorber dye is chosen to provide the effect described. When an anti-halation dye is chosen, for example, it will typically be one with a relatively broad constant absorption over much of the sensitivity versus wavelength curve of the sensitivity dye, and thus would not have the effect of the absorber dye of the present invention.

Basically then, the absorber dye will, around λpeakabs, tend to have an absorbance profile that is similar to the sensitivity profile of the sensitizing dye around λpeaksens. Given that the λpeakabs and λpeaksens are close, and preferably the same, this means that the absorber dye will be absorbing light to an extent corresponding to the sensitivity of the emulsion (that is, more absorbance at higher sensitivity). Thus, speed lossES due to the absorber dye are less at wavelengths other than λpeaksens, at which wavelengths the speed the emulsion would otherwise have is also lower. The result is that the sensitivity of the element over a given wavelength does not change as much as it would if the absorber dye were not present.

Of course, the magnitude of the foregoing effect will generally depend on how closely matched λpeakabs and λpeaksens are, as well as how closely matched are the absorption profiles of the absorber and sensitizing dye (or dye combination), as well as the relative concentrations of absorber and sensitizing dyes. Furthermore, the power available from laser diodes is sufficient such that speed losses due to the presence of the absorber dye are acceptable.

It is preferred that the absorber dye chosen is one with an absorption profile around λpeakabs such that the change in sensitivity of the element around λpeaksens with the absorber dye present, is within 0.05 logE over at least a 5 nm range greater than if the absorber dye was absent. Preferably the absorber dye is chosen such that the foregoing range is at least 7 nm. The element according to the invention, may also have a ½ peak sensitivity profile width which is less than 80 nm, or less than 70 nm (for example, 68 nm, 65 nm, or even 50 nm) and the ratio of the ½ peak sensitivity profile width of the element to the ½ peak absorption profile width of the absorber dye, of less than 1.5. By "½ peak sensitivity profile width", is meant the width of the sensitivity profile of the element, without the absorber dye present, around λpeaksens as measured at ½ the value of the sensitivity at λpeaksens (that is, at 0.3 logE below the sensitivity ct λpeaksens). In the case of a typical photographic silver halide emulsion, the ½ peak sensitivity profile width will therefore be measured with the sensitizing dye in the emulsion. A peak sensitivity profile on a particular sensitized emulsion layer in the photographic element would normally closely correspond with a peak sensitivity profile of the overall element. By "½ peak absorption profile width of the absorber dye" is meant the width of the absorber dye profile in the element (for example, in a gelatin layer), without the emulsion present, around λpeakabs as measured at ½ the absorption at λpeakabs. Photographic elements may be constructed using the invention, which have a λpeaksens in visible or infrared regions, although in one arrangement λpeaksens is limited to being longer than 600 nm.

In one arrangement, two or more sensitizing dyes are present which provide the element with λsensmax but which dyes, in the emulsion and each in the absence of the other, exhibit peak sensitivities which are separated by less than 20 nm or more than 30 nm. In another arrangement the one or more sensitizing dyes provide the element with at least two peak sensitivities, λpeaksens1 and λpeaksens2 (which may, for example, be separated by at least 20 nm), and there are at least two absorber dyes present, each meeting the limitations as previously discussed so as to decrease the change in sensitivity around λsensmax1 and λsensmax2 which the element would otherwise have without the presence of those absorber dyes.

Examples of absorber dyes which might be used with suitably sensitized emulsions are those listed identified with "AD" numbers in Table A (the structures of the dyes are shown below).

TABLE A

| DYE | Type of Dye | ½ Peak Absorption Profile Width (nm) | λpeakabs (nm) |
|---|---|---|---|
| ADI | Absorber | 60 | 779 |
| ADII | Absorber | 90 | 797 |
| ADIV | Absorber | 63 | 800 |
| ADV | Absorber | 60 | 776 |
| ADVI | Absorber | 67 | 784 |
| ADVII | Absorber | 70 | 766 |
| ADVIII | Absorber | 62 | 803 |
| Filter Blue Green | Filter | 200 | 716 |

Examples of sensitizing dyes which might be used in the practice of the invention are those listed with "SD" numbers in Table B (structures of which are shown below). The sensitivity data of Table B was obtained by giving the coatings used 2 second exposures on a wedge spectrographic instrument covering a wavelength range from 400 to 850 nm. The instrument contained a tungsten light source and a step tablet ranging in density from 0 to 3 density units in 0.3 density steps. After processing in a KODAK RAPID X-RAY DEVELOPER for 6 minutes at 20° C., speed was read at 10 nm wavelength intervals at a density of 0.3 above fog. Correction for the instrument's variation in spectral irradiance with wavelength was done by computer. The wavelength of peak sensitivity (λpeaksens) was determined both from the resulting plot of log relative spectral sensitivity versus wavelength and from absorptance spectra of unexposed film coatings. The ½ peak sensitivity profile width was calculated by determining the two wavelengths above and below λpeaksens for which the spectral sensitivity decreased by half (that is, by 0.3 log E) compared to the sensitivity at λpeaksens. The wavelength range of speed within 0.05 log E in Tables 1 and 2 was similarly determined except the two wavelengths were taken for which the spectral sensitivity decreased by 0.05 log E compared to the sensitivity at λpeaksens. The sensitivity data of Table B was obtained with the dyes on a 0.2 μm edge length cubic silver bromoiodide emulsion (bromide to iodide molar ratio of 98 to 2),

TABLE B

| Dye | Type of Dye | ½ Peak Sensitivity Profile Width (nm) | λpeaksens (nm) |
|---|---|---|---|
| SDI | Sensitizing | 65 | 780 |
| SDII | Sensitizing | 47 | 783 |
| SDIV | Sensitizing | 56 | 800 |
| SDV | Sensitizing | 53 | 810 |
| SDVI | Sensitizing | 51 | 776 |
| SDVII | Sensitizing | 62 | 771 |
| CSI | Sensitizing | 115 | 791 |

It will be noted that supersensitizers, such as SSI described below, can also be usefully provided in the emulsion. That sensitizer and other sensitizers which might be used are described in U.S. Pat. No. 5,013,642. Another supersensitizer is that described in European Patent Application 87119271.2 and is of the structure:

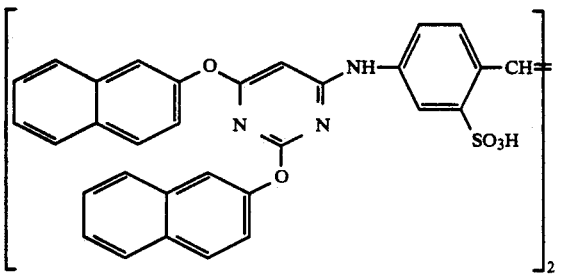

It will be appreciated, of course, that the above listed absorber dyes do not necessarily match with any of the above listed sensitizing dye. In each case, to produce an element of the present invention, the absorber dye and sensitizing dye must be chosen such that the sensitized emulsion and absorber dye have the required parameters. Furthermore, Filter Blue Green is not expected to be a good choice as a suitable absorber dye in the present invention since its ½ peak absorption profile width of 200 nm is very broad. Likewise, sensitizing dye CSI would not expected be used in the present invention since its ½ peak sensitivity profile width peak width is already very broad (115 nm) and further broadening would not likely be useful.

In addition, suitable sensitizing dyes could be synthesized according to techniques that are well-known in the art, such as described in Hamer, *Cyanine Dyes and Related Compounds,* 1964 (John Wiley & Sons, New York) and James, *The Theory of the Photographic Process* 4th edition, 1977 (Eastman Kodak Company, Rochester, N.Y.). Examples of sensitizing dyes that sensitize in the infrared region are described, for example, in U.S. Pat. No. 4,839,265. The amount of a sensitizing dye that would typically be used in the invention is preferably in the range of 0.05 to 2.0 millimoles per mole of silver halide and more preferably from 0.01 to 0.5 millimoles per mole of silver halide. Optimum dye concentrations can be determined by methods known in the art.

The silver halide used in the photographic elements of the present invention may be silver bromoiodide, silver bromide, silver chloride, silver chlorobromide, and the like, which are provided in the form of an emulsion. The photographic elements of the present can use the sensitizing dye with tabular grain emulsions. Tabular grain emulsions are those in which greater than 50 percent of the total projected area of the emulsion grains are accounted for by tabular grains having a thickness of less than 0.3 μm (0.5 μm for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in μm and t is the average thickness in μm of the tabular grains. Of course, the grain size of the silver halide may have any distribution known to be useful in photographic compositions, and may be either polydispersed or monodispersed.

The silver halide grains to be used in the invention may be prepared according to methods known in the art, such as those described in *Research Disclosure,* (Kenneth Mason Publications Ltd, Emsworth, Hampshire, England) Item 308119, December, 1989 (hereinafter referred to as *Research Disclosure I*) and James, *The Theory of the Photographic Process,* above. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation. The silver halide may be advantageously subjected to chemical sensitization with compounds such as active gelatin, sulfur, selenium, tellurium, gold, platinum, palladium, iridium, osmium, rhenium, phosphorous, or combinations thereof and others known in the art. Compounds and techniques useful for chemical sensitization of silver halide are described, for example, in *Research Disclosure I* and the references cited therein.

The photographic elements of the present invention, as is typical, use the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions.

The silver halide may be sensitized by dyes by methods known in the art, such as described in *Research Disclosure I.* The dye may be added to an emulsion of the silver halide grains and a hydrophilic colloid at any time prior to (e.g., during or after chemical sensitization) or simultaneous with the coating of the emulsion in a photographic element. The dye/silver halide emulsion may be mixed with a dispersion of color image-forming coupler immediately before coating or in advance of coating (for example, 2 hours). Essentially any type of emulsion may be used. For example, negative-working emulsions such as surface-sensitive emulsions or unfogged internal latent image-forming emulsions, direct-positive emulsions such as surface fogged emulsions, or others described in, for example, *Research Disclosure I*, may be used.

Other addenda in the emulsion may include antifoggants, stabilizers, light absorbing or reflecting pigments, vehicle hardeners such as gelatin hardeners, coating aids, dye-forming couplers, and development modifiers such as development inhibitor releasing couplers, timed development inhibitor releasing couplers, and bleach accelerators. These addenda and methods of their inclusion in emulsion and other photographic layers are well-known in the art and are disclosed in *Research Disclosure I* and the references cited therein. The emulsion may also include brighteners, such as stilbene brighteners. Such brighteners are well-known in the art and are used to counteract dye stain.

The emulsion layer containing silver halide sensitized with a dye of the present invention can be coated simultaneously or sequentially with other emulsion layers, subbing layers, filter dye layers, interlayers, or overcoat layers, all of which may contain various addenda known to be included in photographic elements. These include, depending on the particular application, antifoggants, oxidized developer scavengers, DIR couplers, antistatic agents, optical brighteners, light-absorbing or light-scattering pigments, and the like. The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

As already mentioned, photographic elements of the present invention can be black and white or color. A color photographic element generally contains three records (each record often consisting of emulsion layers of the same spectral sensitivity but different speed): a first record having a yellow dye-forming color coupler associated therewith; a second record having a magenta dye-forming color coupler associated therewith; and a third record having a cyan dye-forming color coupler associated therewith. For printer film, each of those records would be sensitized to different wavelengths which do not necessarily correspond to the light color absorbed by the dye produced by the color coupler. For example, each record could be sensitized to a different region of the infrared spectrum. The dye forming couplers are provided in the emulsions of the records typically by first dissolving or dispersing them in a water immiscible solvent, the resulting mixture then being dispersed in the emulsion. Dye-forming couplers are well-known in the art and are disclosed, for example, in *Research Disclosure I.*

Photographic elements comprising the composition of the invention can be processed in any of a number of known photographic processes utilizing any of a number of known processing compositions, described, for example, in *Research Disclosure I*, or in James, *The Theory of the Photographic Process* 4th Ed., 1977.

The invention is further described in the following Examples.

EXAMPLE 1

This example mimics a layer which might be used on an infrared sensitive graphic arts scanner film. In practice, such a film would comprise a heavy laydown of a doped (for example, with Rh) silver halide emulsion to give a high contrast (approximately 10), high maximum density image ($D_{max}>5$). Since it is hard to accurately determine speeds of such layers, a model layer was constructed comprising 150 mg/ft$^2$ of an (S+Au) sensitized 0.3 μm edge length cubic $AgCl_{70}Br_{30}$ emulsion thoroughly mixed with 250 mg/ft$^2$ of the same emulsion which had not been chemically sensitized. Neither emulsion was doped and provided an overall contrast (that is, γ) of 2.5 at a density of 1.0 above fog. This emulsion was treated with 500 mg/Ag mole of the super sensitizer SSI and the two antifoggants AFI and 5-carboxy-2-methylmercapto-tetraazaindine. The emulsions were coated on a base of poly(ethyleneterephthalate) in 400 mg/ft$^2$ gel and overcoated with 80 mg/ft$^2$ gel. These gel layers were hardened with 1.5 weight percent bis(vinylsulfonyl)methyl ether (referred to as "BVSE").

The emulsion was spectrally sensitized with 0.025 millimoles/Ag mole of the sensitizing dye SDI.

Sensitivities were measured similarly to those obtained for Table B examples, except the film coatings were exposed for 0.5 seconds on a spectral sensitometer and developed for 35 seconds at 95° F. in Kodak Rapid Scanner Developer diluted 1:4. Normalized photographic speeds at a density of 1.0 above Fog were calculated and plotted at 10 nm intervals. The μmax of the sensitized emulsion (that is, the sensitized dye on an unexposed unprocessed emulsion coating) and the two absorber dyes (each coated separately in gelatin) were measured spectrophotometrically, and recorded as the λpeaksens or λpeakabs.

The above procedure was repeated using combinations of sensitizing and absorber dyes as shown in Table I below. The effects of 1 mg/ft$^2$ of intergrain absorber dyes on the breadth of the spectral sensitization, defined as the wavelength range over which speed stayed constant within ±0.05 log E, is shown in Table 1.

TABLE 1

| Sensitizing Dye | λ peaksens | ½ Peak Sensitivity Profile Width | Absorber Dye | λpeakabs | ½ Peak Absorption Profile Width | Wavelength of Maximum Speed of Element | Speed at Wavelength of Maximum Speed | Wavelength range of speed within ±0.05 log E | Width of range |
|---|---|---|---|---|---|---|---|---|---|
| SDI | 780 nm | 49 nm | None | — | — | 780 nm | 251 | 766–794 nm | 28 nm |
| SDI | 780 nm | — | ADI | 779 nm | 60 nm | 780 nm | 205 | 755–802 nm | 47 nm |
| SDI | 780 nm | — | ADII | 797 nm | 90 nm | 770 nm | 172 | 756–792 nm | 36 nm |

Note that absorber dye ADI has a λpeakabs at almost the same wavelength λpeaksens as sensitizing dye SDI (only 1 nm difference). However, the comparative absorber dye ADII has a λpeakabs which is 17 nm longer. Furthermore, ADII has a much broader absorbance profile than ADI. Thus, the presence of ADII causes an undesirable shift of peak sensitivity of the element from the desired 780 nm to an undesired 770 nm. In addition, ADII provides a sensitivity broadening which is not large, is unsymmetric and furthermore causes considerably decreased sensitivity. On the other hand, the absorber dye ADI in combination with the emulsion using SDI, an example of the invention, provides a large and symmetric broadening of the wavelength range within ±0.05 logE since its peak is at the same wavelength as the sensitizing dye, and since it has a relatively narrow absorption profile. Speed losses in the presence of absorber dyes were large in this example due to the absence of an antihalation or pelloid layer (that is, the layer on the back side of the base) which would have minimized speed gains from back reflected light. Such an example is given below.

EXAMPLE 2

This example used a pelloid layer comprising 3 mg/ft$^2$ of antihalation dye AHI in 400 mg/ft$^2$ gel hardened with 1.5 weight percent BVSME. The emulsion layer was similar to that in Example 1 except that a single (S+Au) sensitized finer grain 0.18 μm $AgCl_{70}Br_{30}$ emulsion was used, at a laydown of 320 mg/ft$^2$. The emulsion was spectrally sensitized with 0.025 mmole per mole Ag, of the 783 nm sensitizing dye SDII (as measured in the emulsion). The broadening effect of adding 1 mg/ft$^2$ of the 780 nm intergrain absorber dye ADI was measured. Results are summarized in Table 2 below.

TABLE 2

| Sensitizing Dye | λpeaksens of sensitized emulsion | ½ Peak Sensitivity Profile Width | Absorber Dye | λpeakabs of absorber dye | ½ Peak Absorption Profile Width | Wavelength of Maximum Speed of Element | Speed at Wave-Wavelength of maximum Speed | Wavelength range of speed within ±0.05 log E | Width of range |
|---|---|---|---|---|---|---|---|---|---|
| SDII | 783 nm | 45 nm | None | — | — | 780 nm | 174 | 767–793 nm | 26 nm |
| SDII | 783 nm | — | ADI | 780 nm | 60 nm | 780 nm | 153 | 762–796 nm | 34 nm |

Example 2 then, provides a lower laydown of a significantly less light scattering emulsion and an additional anti reflection layer on the back side of the base. However, even in such a case a significant and useful broadening of the wavelength range around λpeaksens in which the sensitivity is relatively constant, is achieved on both the short and long wavelength sides, by the present invention. Note also that the finer grain emulsion and the anti-halation layer on the back side of the base gave much smaller speed losses in the presence of the same level of ADI used in Example 1.

Example 1 demonstrates that the broadening of the wavelength range of relatively constant sensitivity (that is, within 0.05 logE) was reduced and restricted to either the longer or shorter wavelength about λpeaksens, when λpeaksens and λpeakabs differed by only 17 nm. Furthermore an undesirable shift in of peak sensitivity of the element with the absorbed dye present, occurred.

Formulae of compounds described above are:

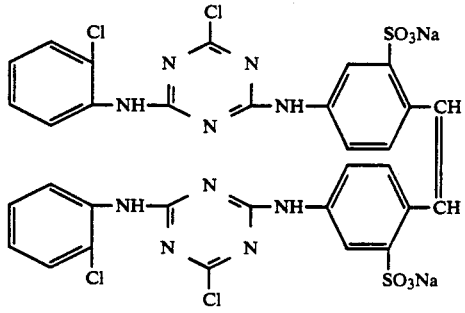

Supersensitizer SSI

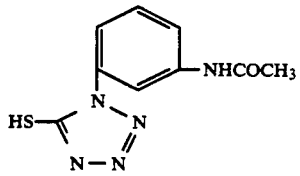

Antifoggant AFI

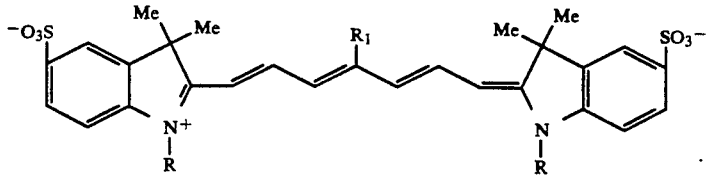

| Absorber Dye | R | $R_1$ |
|---|---|---|
| ADI | 2SEt | Me |
| ADVI | 4SB | Me |
| ADVII | 4SB | H |

4SB = 4-sulfobutyl; 2SEt = 2-sulfoethyl

-continued
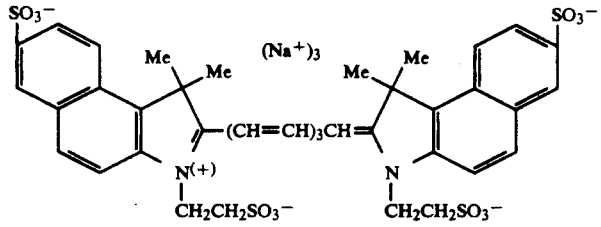
Absorber Dye ADII
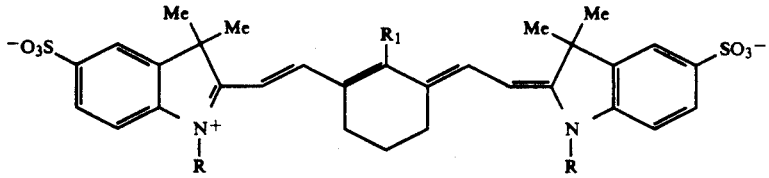
| Absorber Dye | R | $R_1$ |
|---|---|---|
| ADIV | SEt | Cl |
| ADV | SEt | Ph |
| ADVIII | 4SB | Cl |
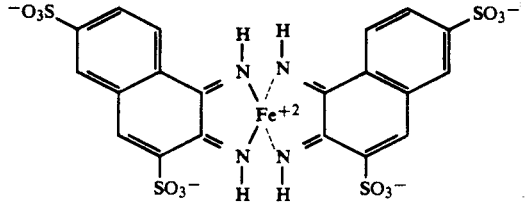
Filter Blue Green
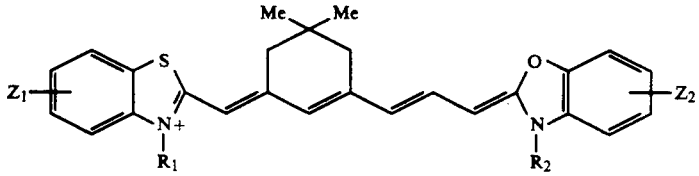
| Sensitizing Dye | $R_1$ | $R_2$ | $Z_1$ | $Z_2$ |
|---|---|---|---|---|
| SDI | Et | Et | 6-Me | 5-Me and 6-Me |
| SDVII | SP | Et | H | H |
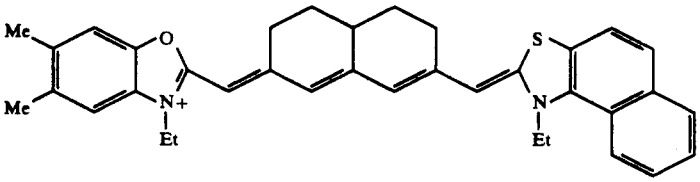
Sensitizing Dye SDII
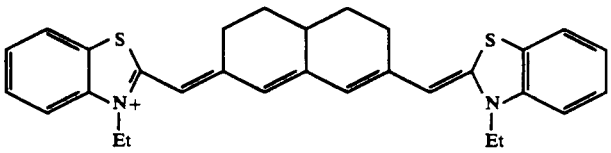
Sensitizing Dye SDIV
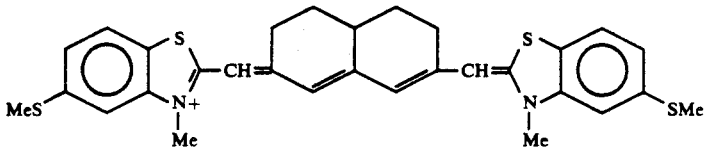

-continued

Sensitizing Dye SDV

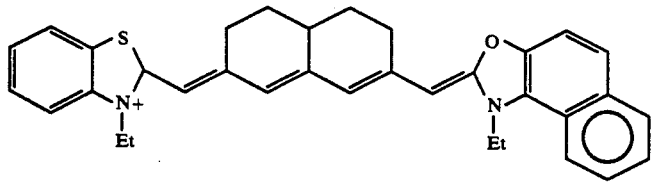

Sensitizing Dye SDVI

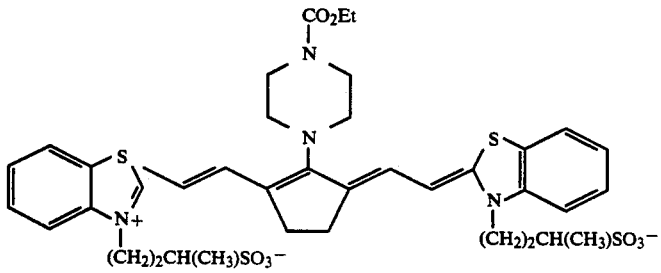

Sensitizing Dye CSI

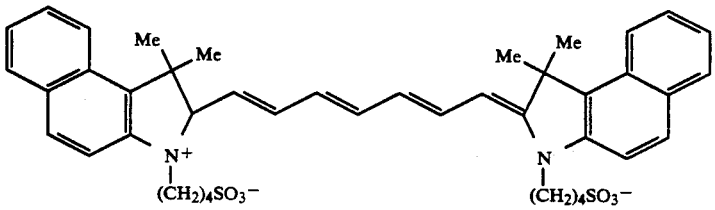

Anti-halation dye AHI

The invention has been described in detail with particular reference to preferred embodiments, but it will be understood that variations and modifications can be effected within the spirit and scope of the invention.

We claim:

1. A photographic element comprising:

a silver halide emulsion sensitized with one or more sensitizing dyes; and an absorber dye disposed in the emulsion or thereabove to be closer to a source of radiation to be detected by the element;

wherein the element has a wavelength of peak sensitivity measured without the absorber dye present, λpeaksens, and decreasing sensitivity therearound, and the absorber dye has a wavelength of peak absorption, λpeakabs, within 10 nm of λpeaksens and a profile of decreasing absorption around λpeakabs so as to decrease the change in sensitivity which the element otherwise has around λpeaksens without the absorber dye present.

2. A photographic emulsion according to claim 1 wherein two or more sensitizing dyes are present which provide the element with λsensmax but which dyes, in the emulsion and each in the absence of the other, exhibit peak sensitivities which are separated by less than 20 nm or more than 30 nm.

3. A photographic element according to claim 1 wherein the one or more sensitizing dyes provide the element with at least two peak sensitivities, λsensmax1 and λsensmax2, and wherein the element has at least two absorber dyes which have respective peak absorptions, λabsmax1 and λabsmax2, within 10 nm of λsensmax1 and λsensmax2, respectively, so as to decrease the change in sensitivity which the element otherwise has around λsensmax1 and λsensmax2 without the presence of the absorber dyes.

4. A photographic element according to claim 1 wherein the ½ peak sensitivity profile width of the element is less than 70 nm and the ratio of the absorber dye ½ peak absorption profile width to the element's ½ peak sensitivity profile width is less than 1.5.

5. A photographic element according to claim 1 additionally comprising an anti-halation dye in the emulsion or thereabove, the anti-halation dye being a different dye that the absorber dye.

6. A photographic element according to claim 1 wherein the absorber dye has a profile of absorption around λpeakabs such that the change in sensitivity of the element around λpeaksens with the absorber dye present is within 0.05 logE over at least an additional 5 nm range than if the absorber dye was not present.

7. A photographic element according to claim 1 wherein the absorber dye has a λpeakabs within 5 nm of λpeaksens.

8. A photographic element according to claim 7 wherein the absorber dye has a profile of absorption around λpeakabs such that the change in sensitivity of the element around λpeaksens with the absorber dye present is within 0.05 logE over at least an additional 5 nm range than if the absorber dye was not present.

9. A photographic element comprising:

a silver halide emulsion sensitized with only a single sensitizing dye such that the element has a wavelength of peak sensitivity, λpeaksens, and decreasing sensitivity therearound; and an absorber dye disposed in the emulsion or thereabove to be closer to a source of radiation to be detected by the element, which absorber dye has a wavelength of peak absorption, λpeakabs, within 10 nm of λpeaksens and a profile of decreasing absorption around λpeakabs, so as to decrease the change in sensitivity which the element otherwise has around λpeaksens without the presence of the absorber dye.

10. A photographic element according to claim 9 wherein the absorber dye has a λpeakabs within 5 nm of λpeaksens of the sensitized emulsion.

11. A photographic element according to claim 9 wherein the absorber dye has a λpeakabs within 2 nm of λpeaksens.

12. A photographic element according to claim 10 wherein the absorber dye has a profile of absorption around λpeakabs such that the change in sensitivity of the element around λpeaksens with the absorber dye present is within 0.05 logE over at least an additional 5 nm range than if the absorber dye was not present.

13. A photographic element according to claim 10 additionally comprising an anti-halation dye in the emulsion or thereabove, the anti-halation dye being a different dye than the absorber dye.

14. A photographic element according to claim 10 wherein the absorber dye is located in the emulsion.

15. A photographic element according to claim 10 wherein the absorber dye is located in a layer above the emulsion.

16. A photographic element according to claim 11 wherein the absorber dye has a profile of absorption around λpeakabs such that the change in sensitivity of the element around λpeaksens with the absorber dye present is within 0.05 logE over at least an additional 7 nm range than if the absorber dye was not present.

17. A photographic element according to claim 11 wherein the ½ peak sensitivity profile width of the element is less than 80 nm and the ratio of the absorber dye ½ peak absorption profile width to the ½ peak sensitivity profile width of the element is less than 1.5.

18. A photographic element according to claim 9 wherein the element has a λpeaksens at a wavelength longer than 700 nm.

19. A photographic element according to claim 9 wherein the element has a λpeaksens at a wavelength longer than 600 nm.

20. A photographic element according to claim 12 wherein the element has a λpeaksens at a wavelength longer than 700 nm.

* * * * *